United States Patent [19]

Bloemendaal

[11] Patent Number: 4,741,529

[45] **Date of Patent: * May 3, 1988**

[54] EXERCISE APPARATUS

[75] Inventor: Brent J. Bloemendaal, Indianapolis, Ind.

[73] Assignee: Bio-Dynamic Innovations, Inc., Indianapolis, Ind.

[ * ] Notice: The portion of the term of this patent subsequent to Feb. 24, 2004 has been disclaimed.

[21] Appl. No.: 777,467

[22] Filed: Sep. 18, 1985

Related U.S. Application Data

[63] Continuation-in-part of Ser. No. 695,077, Jan. 25, 1985, Pat. No. 4,645,199.

[51] Int. Cl.[4] ..... A63B 21/00

[52] U.S. Cl. ..... 272/130

[58] Field of Search ..... 272/72, 73, 130, 132; 188/290, 268

[56] References Cited

U.S. PATENT DOCUMENTS

| | | | |
|---|---|---|---|
| 2,508,217 | 5/1950 | Brell | 188/290 |
| 2,725,231 | 11/1955 | Hoover | 272/72 |
| 3,103,357 | 9/1963 | Berne | 272/130 |
| 3,373,992 | 3/1968 | Ludeman | 272/130 |
| 3,494,616 | 2/1970 | Parsons | 272/73 |
| 3,495,824 | 2/1970 | Cuinier | 272/130 |
| 3,529,474 | 9/1970 | Olsen et al. | 272/130 |
| 3,531,112 | 9/1970 | Gibbs | 272/73 |
| 4,171,802 | 10/1979 | Stoecker | 272/130 |
| 4,509,742 | 4/1985 | Cones | 272/73 |

OTHER PUBLICATIONS

"Only Universal Offers so Many Features" advertisement from Universal Physical Conditioning Equipment Catalog (1985) p. 6.

"Variable Resistance Means Peak Power" advertisement from Paramount (Equipment catalog) p. 3.

*Primary Examiner*—Richard J. Apley
*Assistant Examiner*—S. R. Crow
*Attorney, Agent, or Firm*—Litman, McMahon & Brown

[57] ABSTRACT

An exercise apparatus is provided for use in performing muscle exercise routines, including exercises such as bench presses, arm curls, and leg curls. The exercise apparatus includes a frame, an actuator mechanism, and a resistance mechanism. During an exercise routine, an exerciser moves a bar such as a handlebar, mounted on the actuator mechanism, reciprocatively, through arc movement. A clutch mechanism is provided so that, selectively, as the bar is moved the resistance mechanism is engaged. The resistance mechanism is of a fluid-shearing friction type with a rotating shearing surface acting upon a stationary shearing surface through viscous fluid. The clutch mechanism permits resistance to bar movement to be selectively provided during a forward stroke, or return stroke, or both, during reciprocative movement of the bar. The resistance mechanism includes means permitting an amount of resistance offered by the mechanism to be selectively adjusted.

19 Claims, 4 Drawing Sheets

EXERCISE APPARATUS

CROSS REFERENCE TO RELATED APPLICATION

This is a continuation-in-part of application Ser. No. 695,077 filed Jan., 25, 1985, now U.S. Pat. No. 4,645,199. The parent application U.S. Ser. No. 695,077 is expressly incorporated herein by reference.

BACKGROUND OF THE INVENTION

The present invention relates to exercise equipment and in particular to equipment generally utilized for anaerobic or muscular exercise, wherein for operation an exerciser applies muscular force in opposition to a resistant, or resisting, mechanical force generated in the device.

As resistance is overcome by muscle power, the muscle generally either contracts or lengthens the extension of a body limb, for example a leg or arm. In one form of muscle exercise, isometric exercise, there is no actual substantial change in limb extension during the exercise, rather the muscle is statically stressed at maximum effort for several seconds. Such methods of exercise are widely known and used, but suffer from the limitation that no single isometric exercise effectively stresses a muscle group through its full range of motion To fully exercise a muscle group, in many instances isokinetic-type exercises are preferred. For these exercises the exerciser exerts muscle effort for a relatively long period of time and, the muscle group, by extension or contraction of the related limb, is placed under stress through its essentially full range of motion. For example, certain arm muscles might be exercised from complete contraction to full extension of the arm, as by a typical bench press or arm curl with weights or weight machines.

Maximum advantage in applying force is usually obtained, for a muscle group, near full extension of the limb involved. That is, for certain exercises, as human exercisers fully extend the exercised limb, their ability to apply force increases and the amount of force which may be applied may also increase. As an example, consider a person lying upon a weight bench doing bench presses with a typical weight bar. When the bar is supported close to the person's chest, the arms are nearly fully contracted and the exerciser has difficulty lifting the bar due to the mechanics of the human arm. However, as the arms near full extension, the arms become extended, and movement of the bar becomes easier. Thus, lifting the weight becomes easier for the exerciser as the weight is raised. As a result, for a given weight, the arms may not be exercised as fully near full extension, since the effort which must be expended is not as much of a strain on the exerciser. If the weight would be heavy enough so that strain near full extension would be great, it is possible that the weight would be too heavy to initially be lifted from the chest.

Exercise machines have been developed to provide for an increase in the amount of exertion required, as the limb is extended. For example, in exercise machines simulating bench presses of weights, the operator may move a bar or handle grip with resistance provided by heavy weights. Camming mechanisms have been developed to decrease the mechanical advantage given by the machine to the exerciser as the bar or grip is moved by the exerciser's arm extension. Thus, as the arms of the exerciser extend, it is made mechanically more difficult to move the bar or grip, and the weights become harder to move.

While such devices have been in some ways effective, they suffer from serious problems. First, they are large and bulky, and often very heavy due to the presence of the weights. Secondly, adjustments in the weights may be necessary, in order for the device to be utilizable by numerous persons of different physical abilities, and such changes can be cumbersome. Further, the cams might not always effectively match, or correlate with, the change in the exerciser's ability to impart force during an exercise stroke. Further, for such a correlation to be most effective, numerous cams may be necessary if the device is to be utilized for exercise of different muscle groups, or by different persons.

Another problem with such devices, or the use of conventional weights, is one of safety and convenience. Typically, the exerciser is lifting weights by means of a bar or lever and if muscle exertion is lessened, the weights will force movement of the bar or lever in the opposite direction. If such a motion should occur rapidly, injury could result. For example, the bar could rapidly, and with great force, fall, driven by the weights, and crush the exerciser. Further, it is difficult for a person exercising by such methods to stop in the middle of an exercise stroke, as the weights must be returned to a resting position.

Muscles generally work in pairs. These pairs are not normally balanced, but sometimes it may be desirable to exercise them approximately equally in order to avoid proportional imbalance. For example, there is a group of muscles which permit an arm to be extended, along with a correlating group which permit it to be bent or retracted. It is readily seen that for many exercise routines involving conventional utilization of weights or weight type machines, only exercise of one of a pair of muscle groups is involved. For example, in the typical bench press, the muscle group involving extension of the arms might be exercised, however since the weights tend to fall by themselves, there is no significant chance to exercise the muscle group which pulls the arms toward the chest, in contraction. In some applications, however, it may be preferable to have an exercise apparatus capable, during the same sequence, of accomodating exercising both muscle groups in a set of muscle pairs.

SUMMARY OF THE INVENTION

An exercise apparatus is provided for use by an operator in receiving physical exercise, typically a muscle workout. In the preferred embodiment, the apparatus is selectively operable for use in performing bench press exercises, arm curls, or leg curls, as desired. However, the principles of the invention might be applied to a variety of muscle exercises, as will be understood from the below description.

The apparatus generally comprises a frame, a resistance means or mechanism, and an actuator means or mechanism. In operation, an exerciser manipulates or moves the actuator mechanism by engaging and moving body contacting means or actuator member. Movement of the actuator member, however, is resisted by the resistance mechanism. By rough analogy, in a typical barbell-type weight exercise, the actuator mechanism would comprise the bar which is held by the exerciser and lifted, and the resistance mechanism would comprise the weights being acted upon by gravity.

In the exercise apparatus, the frame generally comprises a structure appropriate for supporting the resistance mechanism and associated actuator mechanism in desired orientations relative to one another and, also, in preferred orientation for access by an exerciser. Preferably, the frame includes a bench which may be utilized by an exerciser performing bench presses with the apparatus. Also, in the preferred embodiment, the frame may be utilized to position the exerciser or operator, with respect to the resistance mechanism and actuator mechanism, for performing arm curl exercises, or, when desired, leg curl exercises.

Many of the advantages of the present apparatus are related to the utilization of a fluid-shearing friction type resistance mechanism in such an isokinetic-type exercise device. The principles of a fluid-shearing type resistance mechanism were taught in the parent application, which has been incorporated herein by reference. In the parent application, such a mechanism was utilized in the embodiment of an exercise bicycle, where aerobic exercise, that is exercise of the heart and lungs, was desired. Here, as will be described below, a fluid-shearing type resistance mechanism is appropriately modified for utilization with muscle exercise equipment.

In a fluid-shearing type resistance mechanism, fluid-shearing means generates the resistance which, in operation, opposes the operator's movement of the actuator mechanism. The fluid-shearing friction means includes, at least, first and second resistance members which undergo shearing, or overlapping, movement with respect to one another. In the preferred embodiment, the first resistance member is a rotor face which rotates relative to the second resistance member, a stationary face in a cover or housing. In operation, viscous fluid is positioned between the resistance members, and is sheared by movement of the resistance members relative to one another. The resulting friction tends to cause drag to rotation of the rotor. Energy on the part of the operator is needed to overcome this drag, and in imparting this energy the operator or exerciser receives physical exercise.

In the preferred embodiment, the resistance mechanism comprises a rotor, securely mounted upon a rotating axle, which is selectively rotated in a chamber positioned between a housing and cover. When sufficiently viscous fluid is forced into fluid receiving spaces located between the rotor and housing, or rotor and cover, the frictional drag or resistance to rotation of the rotor is generated by the shearing action of the rotor surface with respect to the housing and cover, acting through the fluid. As indicated above, the operator, selectively, receives exercise in overcoming this resistance.

In the preferred embodiment, the rotor is a generally a flat plate, having first and second shearing or resistance surfaces The rotor is orientated in a generally vertical plane and rotates as the axle is rotated by the operator.

As indicated above, the rotor is oriented within a chamber between a housing and a cover and selectively rotates with respect to stationary resistance and shearing surfaces in both the housing an cover. The fluid receiving spaces are positioned between the rotor and the housing, and also between the rotor and the cover. When fluid is conveyed into the fluid receiving spaces, the frictional drag on rotation of the rotor relative to the housing and cover is generated. This drag, or resistance, may be increased or decreased by varying the amount of fluid in the fluid receiving spaces, with the general condition that the greater the amount of fluid, the greater the amount of frictional drag. The method of transmitting the fluid into the fluid receiving spaces generally places the fluid along a circumferential perimeter of each of the two surfaces or friction faces of the rotor. This type of resistance mechanism, again, is generally referred to herein as a fluid-shearing type resistance mechanism or friction resistance mechanism.

For a fixed volume of fluid located between the rotor and the housing, the distance between the rotor and the housing is related to the amount of frictional drag generated. Generally, for a fixed volume of fluid, the greater the distance between the rotor and the housing, the less will be the frictional drag, since less surface area of the rotor and the housing will be covered by the fluid. Alternatively stated, as the distance between the rotor and housing increases, the shearing action of the fluid decreases, and rotation becomes easier. Similarly, the distance between a rotor and the cover will be important. At a great enough distance, resistance becomes negligible.

The device includes a fluid level adjustment means by which an amount of fluid located in the fluid receiving spaces between the rotor, and housing and cover, can be varied and controlled. When the amount of fluid is increased, as indicated above, the amount of resistance to rotating action of the axle and rotor is generally increased.

If the rotor is substantially circular, and the cover and housing along shearing faces, that is faces where they overlap the rotor, are substantially flat and parallel to the rotor, then generally constant frictional drag, at a fixed fluid level, is experienced throughout single rotation of the rotor. This latter observation assumes that the rotational speed of the rotor is constant and the temperature and viscosity of the fluid remain relatively constant. Even if the rotor were circular, but the cover and housing surfaces facing the rotor were not flat, constant frictional drag would still be generated for a fixed fluid level and constant rotational speed, since the circular rotor would generally create a constant shearing action or constant friction overlapping with the cover and housing. Similarly, if the rotor were not circular, but the housing and cover surfaces facing the rotor were generally flat and parallel to the rotor, there would be no significant variance in resistance during a single rotation at constant speed. However, if the rotor were not circular, and the housing and cover surfaces facing the rotor were not radially symmetrical, as the rotor rotated shearing action would vary since total overlap between the shearing faces would vary. In the preferred embodiment, the rotor is non-circular, having a somewhat oval shape. Generally, the rotor can be described as a circle with two equal and opposite, curved, chordal segments or crescents removed therefrom, leaving the somewhat oval shape. Such a shape has been found to be useful in assuring proper fluid flow and drainage within the assembly.

As will become more apparent from the detailed description, for the present application of a fluid-shearing resistance mechanism, it is believed generally preferable for resistance to rotation of the rotor to remain relatively constant through a single rotation at a fixed speed. In this way the exerciser will feel a relatively smooth stroke in using the apparatus. Since a non-circular rotor is preferred, to achieve the constant frictional drag it is preferable that the cover and housing areas facing the rotor be relatively flat and parallel to the rotor, so that rotation of the non-circular rotor does not result in significant variance in frictional overlap between the rotor, housing and cover, during rotation. In the preferred embodiment, a fluid-shearing resistance mechanism is utilized which is also adaptable for use in a bicycle-type exercising device such as that described in the parent application. There, the cover and housing surfaces facing the rotor included relief portions or spaces therein so that as the rotor was rotated the amount of frictional drag or friction generating overlap would vary during a rotation, and periodically repeat. For the instant application, with muscle exercise apparatus, certain of the relief spaces, as described below, are filled with inserts or spacers, thus substantially cancelling their effect and presenting a relatively flat surface on the cover and housing portions facing the rotor. It will be readily seen from the detailed description, that, if desired, the inserts could be removed completely, or replaced with partial inserts, permitting the device to be utilized with variation in frictional drag, on a periodically repeating cycle, as desired.

It is apparent that a variety of designs of rotors, housings and covers may be utilized according to the present invention. Generally, it is the amount of surface area between which the fluid is trapped which controls the amount of frictional drag created. Also, for a given volume of fluid, as indicated above, the distance between the rotor and housing is important, since the greater the distance, the less will be the amount of friction generated by the shearing.

For the preferred embodiment, fluid having a viscosity of approximately 9000 centistokes is used. However, a range of about 3000 centistokes to about 22,000 centistokes is believed operable. A stoke is a conventional unit of viscosity related to the length of time it takes a certain volume of material to flow a certain distance. For the preferred embodiments, silicon fluids are utilized and their consistency is observed to be generally similar to that of a cross between honey and molasses. Two such silicon fluids are believed to be marketed under the trade names: Dow-Corning 211; and, Union Carbide 404.

While the fluid possesses significant viscosity, it is still sufficiently free flowing that it will tend to become smeared and adhere to much of the internal portions of the rotor and axle mechanism, if it is allowed to do so. In the preferred embodiment, a wiper mechanism is provided in association with the rotor. The wiper mechanism continuously redirects the fluid to that portion of the rotor which it is preferred be covered thereby. Generally, the wiper mechanism operates by directing the fluid to an outer periphery of the rotor.

The wiper mechanism comprises a flexible blade which is pressed against the rotor surface. As the rotor rotates, the fluid is pushed against the wiper blade and is directed by the shape of the wiper toward the outer periphery of the rotor.

A fluid level adjustment mechanism including a fluid reservoir is provided so that the total amount of fluid between the rotor and housing may be varied. When the amount of fluid between the rotor and housing is increased, resistance to rotation to the rotor becomes greater. The fluid reservoir is generally symmetrically positioned with respect to the rotor and includes a plunger, also generally symmetrically positioned with respect to the rotor, which is actuated to force fluid into, or allow fluid to escape from, the chamber in which the rotor rotates. More specifically, the spaces between the rotor and housing, and rotor and cover, are referred to as the fluid receiving spaces. When fluid is forced into the fluid receiving spaces, frictional drag increases. Actuation of the plunger in the fluid reservoir permits the level of fluid in the fluid receiving spaces to be controlled. A potential problem with such fluid-shearing resistance mechanisms is that an excess fluid build-up on the rotor may occur, when it is desirable that an amount of fluid on the rotor, at any given time, remain relatively constant, or at least contained within certain predetermined limits. In the preferred embodiment, a scraper mechanism is utilized to maintain control of the amount of viscous fluid on the rotor. The scraper mechanism includes an outside diameter scraper, which selectively removes excess fluid from an outer rim of the rotor. The scraper mechanism also includes side scraper means utilized to remove excess fluid from certain rotor surfaces.

It is foreseen that the fluid level adjustment mechanism, which comprises the plunger and fluid reservoir, may be controlled either manually or electronically, as by a computer. With computer control, programming for varying resistance, pursuant to a predetermined plan, may be possible, so that a change of resistance during an exercise routine, according to such a plan, is possible.

The actuator mechanism includes means by which the operator selectively rotates the rotor, to receive exercise. A variety of actuator mechanisms may be utilized and in the preferred embodiment portions of the actuator mechanism are selectively variable so the rotor may be rotated by the operater performing bench presses, arm curls, or leg curls, as desired.

In the preferred embodiment, the actuator mechanism comprises a rotating member such as a drive gear and an actuator bar or actuator member arrangement. The actuator bar arrangement includes an engagement device of means by which the drive gear is selectively engaged and rotated upon movement of an actuator bar by the exerciser. The drive gear is arranged in cooperation with the rotor, so that the rotor is selectively driven by the operator during rotation of the drive gear. That is, the engagement device selectively couples the actuator member to the resistance mechanism rotor. Bench presses, arm curls, and leg curls, utilizing the apparatus, are similar, in that for each, an actuator bar is moved through an arc by the exerciser. For a bench press, the exerciser lies upon his back with the actuator bar extending above and laterally across his chest. Upward pressure on the bar results in a relatively standard bench press.

In the preferred embodiment, the actuator bar is attached to a lever arm arrangement which is mounted upon an axle. As the actuator bar is pushed upwardly, the lever arm rotates somewhat about the axle, moving the actuator bar through an arc. As will be seen from the detailed description, taken in combination with the drawings, leg curls and arm curls involve similar arc movement of an actuator bar.

For such exercises, it is generally preferred that the arc movement of the actuator bar be reciprocative. That is, that there be a first stroke by which the actuator is moved in a first direction, or forwardly, through the arc, and a second stroke, or return stroke, by which the actuator bar is returned. Thus, the actuator means includes a reciprocating mechanism whereby the actuator member or bar is reciprocatively moved through first and second extreme positions, along the arc. In a bench press, for example, there is a first stroke during which the actuator bar is lifted, and a second stroke during which it is lowered. A similar situation exists for arm curls and leg curls. "Reciprocating mechanism" is a general term used herein to refer to means for providing such reciprocative movements in the muscle exercise apparatus. The presence of a reciprocating mechanism is responsible for one of the fundamental differences between the instant application of the fluid-shearing resistance mechanism and the parent bicycle-type exercise device.

It is conceivable that under certain circumstances it may be desired that the resistance mechanism provide resistance to actuator bar movement during both the first stroke and the second stroke, or during only one or the other, depending upon the muscle group or groups to be exercised. In the preferred embodiment, these possibilities are provided by a three-way clutch mechanism associated with the actuator bar as follows:

The drive gear is mounted upon, and rotates on, a central axle. A pair of yoke arms is also rotationally mounted upon the axle, each arm being capable of independent motion with respect to the drive gear, and with one yoke arm mounted on either side of the drive gear. The yoke arms support a lever arm on which the actuator bar is mounted. The lever arm includes the three-way clutch mechanism selectively engaging teeth on the drive gear. Thus, as the actuator bar is moved through an arc, the lever arm pivots on the yoke arms, about the axle, and, if the clutch is appropriately adjusted, the drive gear is rotated, engaging the resistance mechanism and providing resistance. On the other hand, if the clutch is adjusted for disengagement, while movement of the actuator bar generates movement of the lever and yoke arms, the drive gear is not engaged and is not rotated, the resistance mechanism is not operated, and relatively little resistance is offered to the movement.

In the preferred embodiment, the three-way clutch mechanism includes first and second pawls. Each pawl is selectively adjustable for engagement with the drive gear, the first pawl being selectively engageable during the first stroke, but selectively disengaged during the return, and the second pawl being selectively engageable during the return stroke, but selectively disengaged during the first stroke. Thus, the resistance mechanism may be engaged during the first stroke, the second stroke, or both, as desired.

In the preferred embodiment, the lever arm and/or actuator bar is removably mounted in the actuator mechanism and may be replaced by a variety of lever arm or actuator bar arrangements. Thus, if different shapes are preferable for use by different persons, or in different exercise routines such as in bench presses, arm curls, or leg curls, changes may be readily made.

From the previous, summary, description, numerous advantages of the the present apparatus are readily understandable. First, resistance, may be provided either during the first stroke, the return stroke, or both, as desired. Thus, both the "extension" and "contraction" groups of muscles, or either, may be selectively exercised.

Also, since no significant weight or spring-type mechanism is involved, the resistance mechanism does not tend to drive the lever arm and actuator bar in a direction opposite to force applied by the operator. That is, for example, during a bench press with the apparatus there is no substantial weight tending to force the actuator bar down upon the exerciser. Consider an exerciser doing the bench press, with the clutch mechanism engaged for upward movement of the bar and disengaged for downward movement. As the exerciser performs the bench press, pushing the actuator bar upwardly, resistance is felt. However, if the exerciser becomes tired or injured and stops pushing, there is no substantial weight tending to drive the bar rapidly downwardly with great force. Rather, the lever arm would simply become disengaged from the drive gear and the bar would easily move through a downward arc. In the preferred embodiment, appropriate resistance inducing washer means is utilized to provide sufficient resistance to rotation of the yoke arms about the axle so that if, during the previously described bench press, the operator should cease upward pressing on the bar, the lever arm would generally just remain in place or slowly lower rather than abruptly fall downwardly.

Also, it will be understood that the described mechanism will generally be self-adjusting to provide increased resistance as the ability of the exerciser to apply force increases. This follows from the general characteristic of such fluid-shearing resistance mechanisms that the faster the rotor is rotated, the greater the total amount of resistance. Thus, in the previously described bench press in which the clutch is engaged for the first stroke, for a work-out the exerciser need simply press as hard as he can against the actuator bar. The actuator bar will slowly move through its upward arc, as the resistance mechanism permits the rotor to rotate with frictional resistance. During that portion of the stroke in which the operator is strongest, the relative speed of the arc movement will increase, but so does the total resistance since the rotor rotates faster. Thus, it generally does not become substantially easier for the exerciser to cause the actuator bar to move, rather the rate at which the bar moves simply increases. The exerciser, however, is pushing as hard as he can throughout the entire stroke, giving his arm muscles exercise, with significant stress, throughout their complete extension. It will be understood that the amount of exercise received by the exerciser can be evaluated by timing the stroke, and an evaluation of muscle capability can be made by measuring the length of time it takes to complete partial arcs at different portions of the stroke. Generally, for a bench press, as the bar moves upwardly speed will increase, since the arms become extended, and the exerciser is effectively "stronger".

It is also foreseen that exercise devices encompassing the present invention may be utilized as diagnostic tools. For example, relatively weak or strong portions in the exerciser's limb extension can be located by timing each stroke and segments thereof.

The apparatus is also readily adjustable for increased total resistance if desired; that is, by simply adjusting the amount of fluid in the fluid receiving spaces, by fluid level adjustment means.

A particular advantage to the present invention is that the mechanism is relatively simple and problem free, and does not involve large, heavy pieces, such as weights. Thus, even very strong exercisers can be acommodated by a relatively light piece of equipment. Further, the equipment is readily adjustable for use by very strong or comparatively weak persons.

OBJECTS OF THE INVENTION

Therefore, the objects of the present invention are: to provide an exercise apparatus which requires an operator to expend energy in reciprocatively moving an actuating bar member through an arc; to provide such a device in which resistance to actuator bar movement is selectively provided by a fluid-shearing type friction resistance mechanism; to provide such a device in which the resistance mechanism includes a rotor, housing and a cover; to provide such a device in which the rotor has at least one friction shearing surface which rotates, in an overlapping manner, with respect to stationary shearing surface in the device, with a fluid receiving space therebetween; to provide such a device in which fluid positioned between a rotor friction surface and a stationary surface generates frictional resistance or causes drag to rotation of the rotor; to provide such an apparatus in which an amount of fluid positioned between a rotor friction surface and a stationary surface can be adjusted to increase or decrease the amount of power needed to move the actuator bar and rotate the rotor; to provide such an apparatus in which resistance to actuator bar movement can be selectively provided during a first, forward stroke, a second, return stroke, or both, as desired; to provide such an apparatus including a bench which is utilizable for bench press exercises; to provide such an apparatus which is selectively utilizable for bench press exercises, arm curl exercises, or leg curl exercises; to provide such an apparatus in which the actuator bar does not press downwardly, with substantial weight, on an exerciser during a bench press; to provide such a device in which, if an exerciser presses against the resistance mechanism with maximum effort, resistance increases as the ability of the exerciser to impart such a force increases; to provide such a device in which the rotor rotates between the housing and the cover; to provide such a device in which fluid may be positioned between the rotor and housing and also between the rotor and the cover to cause frictional drag to rotation of the rotor; to provide such a device in which heat, which may be transferred to the fluid, may be relatively rapidly dissipated, so that the viscosity of the fluid is not substantially changed during rotation of the rotor; to provide such a device which includes a wiper for controlling positioning of the fluid on the rotating rotor; to provide such a device which includes a scraper mechanism for generally controlling an amount of fluid adhering to or moved by the rotor; to provide such a device which is relatively light in weight and compact in construction; to provide such a device which is relatively inexpensive to produce; and to provide such a device which is relatively easy to manufacture, relatively simple to use and which is particularly well adapted for the proposed usages thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof. In some instances, material thickness and distances between portions of the device have been exaggerated or reduced for clarity and simplification.

DETAILED DESCRIPTION OF THE PREFERRED EMBODIMENT

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather merely as a basis for the claims and as a representative basis for teaching one skilled in the art to variously employ the present invention in virtually any appropriately detailed structure.

Figure 1:
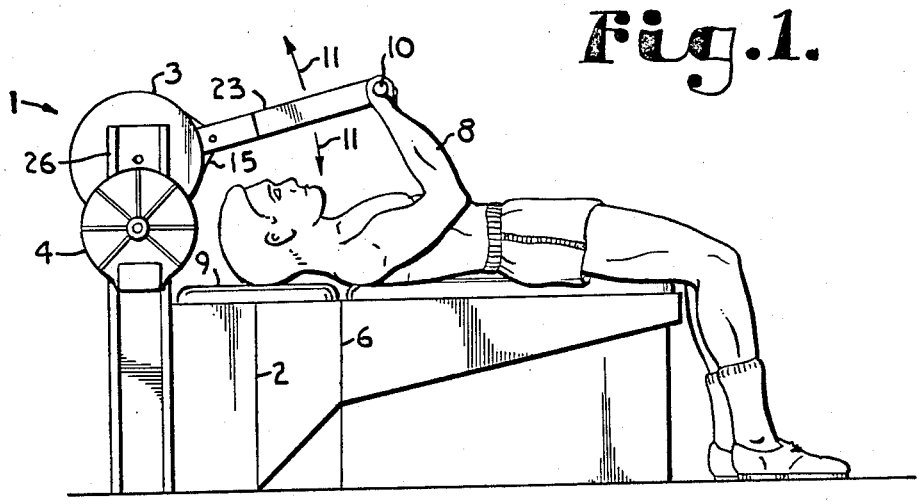
FIG. 1 is a side elevational view of an exercise apparatus, according to the present invention, shown being utilized by an operator in performing a bench press type exercise.
Figure 2:
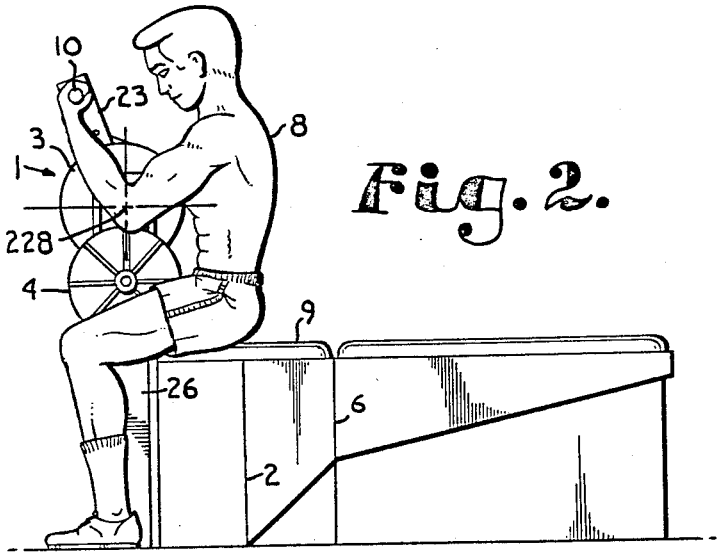
FIG. 2 is side elevational view of an exercise apparatus, according to the present invention, shown being utilized by an operator in performing an arm curl type exercise.
Figure 3:
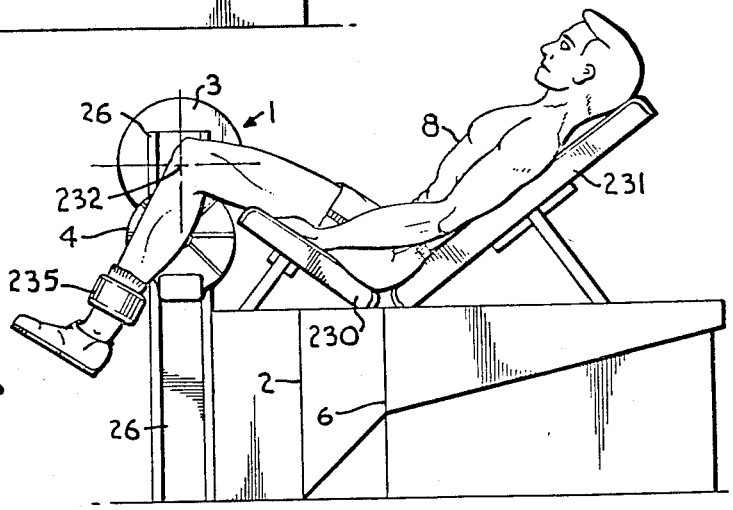
FIG. 3 is side elevational view of an exercise apparatus, according to the present invention, shown being utilized by an operator in performing a leg curl type exercise.
Figure 4:
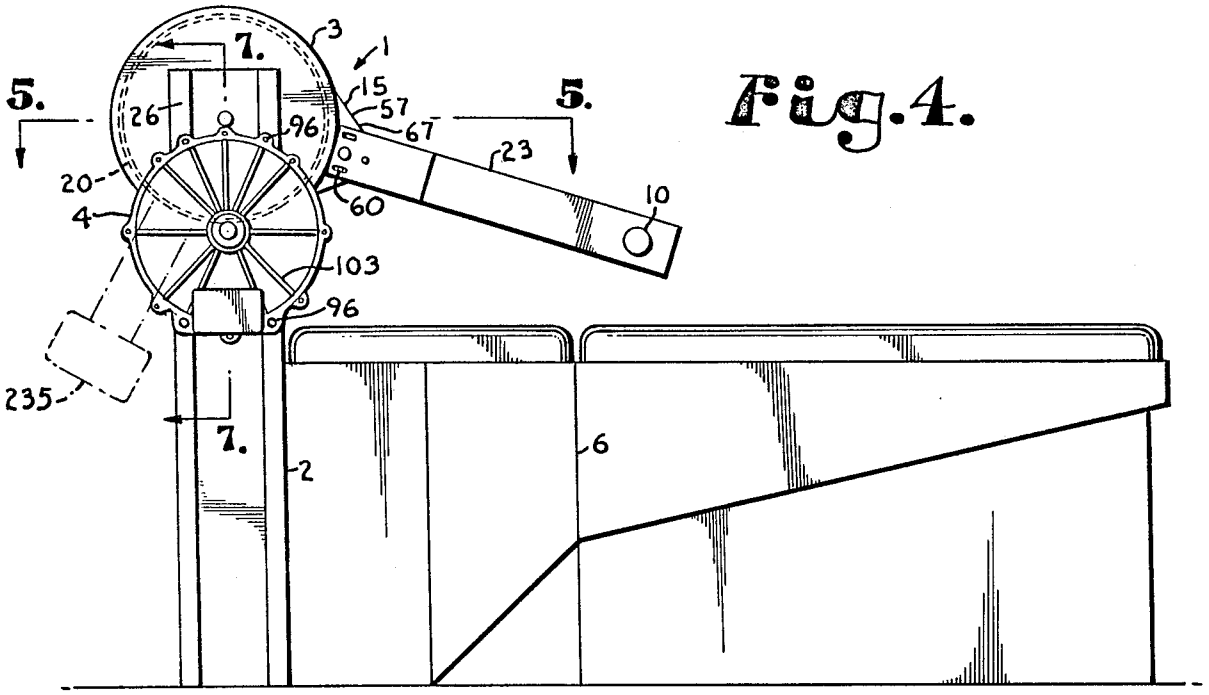
FIG. 4 comprises an enlarged side elevational view of an exercise apparatus according to the present invention.

The reference numeral 1, FIGS. 1 and 4, generally designates an exercise apparatus according to the present invention. For the preferred embodiment described, the exercise apparatus 1 comprises a frame 2, an actuator mechanism 3 and a resistance mechanism 4. Preferrably, the frame 2 includes an adjustable bench 6 whereby the apparatus 1 may be utilized for a variety of exercises. For example: FIG. 1 illustrates utilization of the apparatus 1 for bench press type exercises; FIG. 2, on the other hand, exemplifies utilization of the apparatus 1 for arm curl exercises; while FIG. 3 illustrates utilization of the apparatus 1 for leg curl type exercises. For most of the detailed description, the apparatus 1 will be described as shown in FIGS. 1 and 4 for bench press type exercises. It will be understood that analogous principles apply to the orientations shown in FIGS. 2 and 3, in most instances. Specific descriptions directed to FIGS. 2 and 3 are made below, where appropriate for understanding.

Referring to FIG. 1, an operator or exerciser 8 is shown utilizing the apparatus 1 for a bench press type exercise. For the exercise, the exerciser 8 rests upon an upper surface 9 of the bench 6, facing upwardly. The exerciser 8 grips an actuator member such as press bar or handlebars 10 and pushes upwardly, or pulls downwardly, as necessary to receive exercise, in part simulating a typical bench press done with barbell type weights. The handlebars 10 comprise a portion of the actuator mechanism 3.

Resistance to motion of the handlebars 10 is selectively provided by the resistance mechanism 4, which may be engaged by the actuator mechanism 3. If the resistance mechanism 4 is fully engaged, resistance to motion of the handlebars 10 is provided. On the other hand, if the resistance mechanism 4 is disengaged, resistance to motion of the handlebars 10, along the arc or path of movement indicated by arrows 11, FIG. 1, as described below, is substantially removed. As is described in detail later, a three-way clutch mechanism 15, FIG. 6, permits the resistance mechanism 4 to be engaged during a first, forward, or upward stroke, FIG. 1, or during a second, return or downward stroke, or both, as desired. Thus, substantial resistance to movement of the handlebars 10 may be selectively provided during an upward push on the handlebars 10, or a downward pull, or both as desired. This enables exercise of differing muscle groups, as one muscle group may by involved in the extension of the arms, and a second muscle group may be involved in their contraction.

Figure 5:
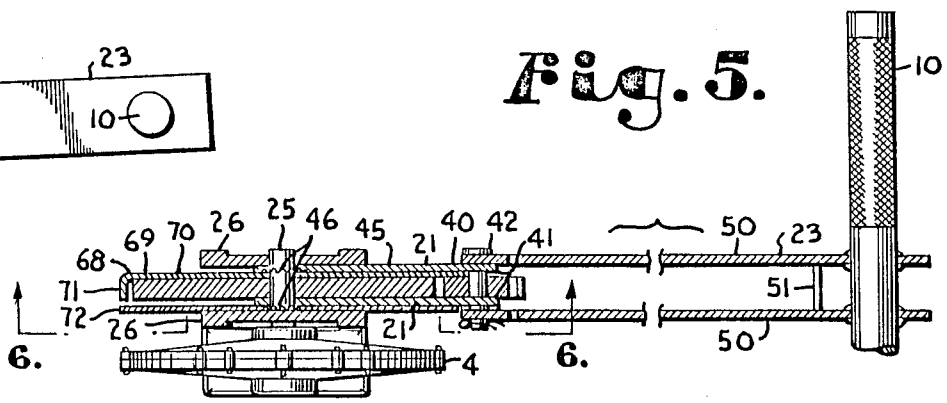
FIG. 5 is an enlarged, fragmentary, top cross-sectional view of a portion of the apparatus shown in FIG. 4, taken generally along line 5—5 of FIG. 4.
Figure 6:
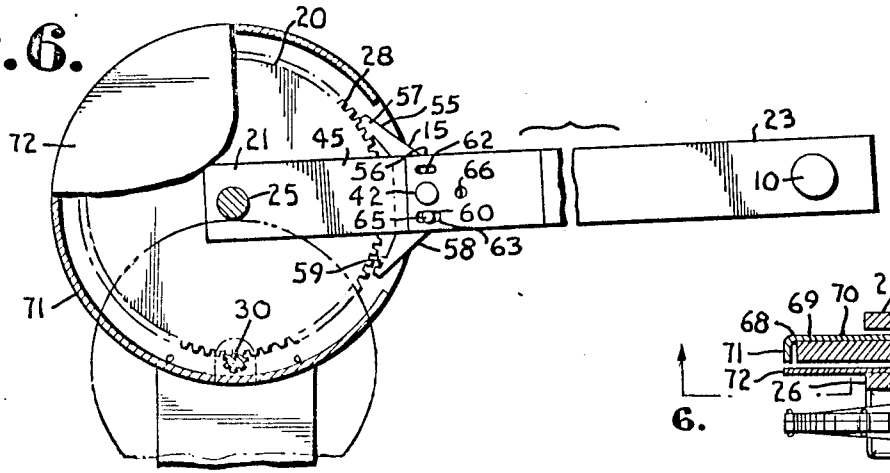
FIG. 6 is an enlarged, fragmentary, side cross-sectional view of a portion of the apparatus taken generally along line 6—6 of FIG. 5.

The actuator mechanism 3 is understood by reference to FIGS. 4, 5 and 6, and it includes a drive gear 20, opposite yoke arms 21, lever arm 23, handlebars 10 and the clutch 15. The drive gear 20 is rotatably mounted upon an axle 25 which is suspended between two upright post members 26 of the frame 2. In the preferred embodiment the drive gear 20 rotates in a substantially vertical plane.

The drive gear 20 includes teeth 28 on its outer circumferential area. Referring to FIG. 6, the drive gear 20 meshes with a toothed axle gear 30 on the resistance mechanism 4. In this manner, the actuator mechanism 3 transmits motion to the resistance mechanism 4. As the drive gear 20 is rotated, the resistance mechanism 4, by means of the gear 30, is driven. Resistance means, described in detail below, selectively causes the axle gear 30 in the resistance mechanism 4 to resist rotation by the drive gear 20. It is the need to impart force to overcome this resistance which results in physical exercise to the exerciser 8.

The yoke arms 21, lever arm 23, clutch mechanism 15 and handlebars 10 cooperate to selectively engage and rotate the drive gear 20 as the handlebars 10 are manipulated by the exerciser 8. Referring to FIGS. 5 and 6, the yoke arms 21 comprise a pair of extensions 40 rotatably mounted on the axle 25. The extensions 40 are capable of rotation about the axle 25 independently of the drive gea 20. The extensions 40 are connected near their outer ends 41 by a pivot bar 42. In this manner, the extensions 40 form a yoke 45 which can be rotated about the axle 25, again independently of the drive gear 20. A friction inducing mechanism such as wave washers 46, positioned between the yoke arms 21 and post members 26, generates frictional resistance to rotation of the yoke 45 about the axle 25, sufficient to prevent the yoke 45 from being too loosely mounted.

Referring FIGS. 1 and 5 were the exerciser 8 to release the handlebars 10, the yoke 45 would loosely rotate and the handlebars 10 would rapidly fall upon the exerciser 8, but for the resistance offered by the wave washer 46, if the apparatus 1 were in a mode in which the resistance mechanism 4 was not fully engaged during a downward stroke. This will become more apparent as the clutch mechanism 15 is further described.

The lever arm 23 is pivotally mounted upon the pivot bar 42, FIG. 5. In the preferred embodiment, the lever arm 23 comprises first and second lateral extensions 50 braced for strength by cross braces such as cross brace 51, however it willI be readily understood that a variety of lever arm designs may be utilized in conjunction with the present invention, and, the lever arms may be removably mounted in the apparatus 1 so that different lever arm and handlebar arrangements may be utilized for different exercisers or exercises.

It is foreseeable that a variety of clutch mechanisms may be utilized to act as an engagement device coupling the handlebars 10 to the resistance mechanism 4 by generating engagement between the lever arm 23 and the drive gear 20, selectively, as the handlebars 10 are maneuvered by the exerciser 8. In the preferred embodiment described, the clutch mechanism 15 includes a dual pawl 55 mounted upon an end 56 of the lever arm 23. The dual pawl 55 includes a first, upper, pawl member or extension 57 and a second, lower, pawl member or extension 58. Each pawl extension 57 and 58 includes appropriate teeth 59 thereon which are oriented for selective engagement with the drive gear teeth 28. It will be understood by reference to FIGS. 5 and 6 that as the lever arm 23 is pivoted about the pivot bar 42, the dual pawl 55 rocks, or pivots, and selectively engages the drive gear 20.

Specifically, referring to FIG. 6, the apparatus 1 is shown with the upper pawl extension 57 in engagement with the drive gear 20, as a result of an upward pivoting of the lever arm 23 about the pivot bar 42. Again, referring to FIG. 6, were the handlebars 10 are to be pulled downwardly, the lever arm 23 would rock or pivot about the pivot bar 42 16 in a downward arc, pulling the upper pawl extension 57 out of engagement with the drive gear 20. Further, in the absence of a stop mechanism, continued downward pulling on the handlebars 10 would further pivot the lever arm 23 until the lower pawl extension 58 engaged the drive gear 20. Thus, in the absence of a stop or control mechanism, upward pressure on the handlebars 10 would cause the drive gear 20 to be engaged and rotated; and, also, downward pressure on the handlebars 10 would cause the drive gear 20 to be engaged and rotated. Therefore, resistance to movement of the handlebars 10 by the resistance mechanism 4 would be caused during a first, forward, stroke or arc movement of the handlebars 10 and also during a second, downward, return stroke or movement of the handlebars 10, exercising not only the muscles which extend the arms during a bench press, FIG. 1, but also the muscles which cause the arms to contract during a return or reciprocating motion. This is a manner in which the apparatus 1 differs fundamentally from a simple bench press with weights or standard weight machines, in which substantially only the muscle group extending the arms is placed under great stress during an exercise routine.

The above described actuator mechanism 3 will be generally referred to herein as a reciprocating type actuator or reciprocating mechanism. That is, the exerciser 8 moves the activator member of handlebars 10 through reciprocating motion; i.e. a forward stroke and a return stroke, the return stroke being through a reverse arc to the forward stroke, with total arc movement being between first and second extreme positions. Typically, the reciprocating motion is repeated numerous times during a physical exercise routine. This would usually be the case for numerous muscle exercises including the bench press type exercise of FIG. 1, the arm curl type exercise of FIG. 2, and the leg curl type exercise of FIG. 3.

It is foreseen that in many applications it may be preferred that the resistance mechanism 4 only be engaged during just the forward stroke and that there be relatively little resistance to movement of the handlebars 10 during the return stroke. Alternatively, resistance may be desired during the return stroke only, and not during the forward stroke. Referring to FIGS. 4 and 6, the clutch mechanism 15 includes a stop means or pin mechanism 60 to permit selected control of engagement between the dual pawl 55 and the drive gear 20.

Referring to FIG. 6, the lever arm extensions 50 include upper and lower oval shaped bores 62 and 63 therein, each arm extension having an upper and lower bore, 62 and 63, respectively. With respect to the bores 62 and 63, the arm extensions 50 are substantially mirror images of one another. An appropriate location of the oval bores will be readily understood from the following description:

The oval bores are positioned approximately in coordination with the outer ends 41 of the yoke arm extensions 40. If the lateral extensions 50 were appropriately pivoted about pivot bar 42, in order to extend colinearly with the yoke arms 21, the oval bores 62 and 63 would generally partially overlap the lever arm extensions 40, and partially would not.

Referring to FIG. 6, a pin 65 is provided for use in association with the oval bores 62 and 63. In FIG. 6, the pin 65 is shown inserted through lever arm 23 by insertion through the lower oval bores 63 and extension laterally across the lever lateral extensions 50. If, in FIG. 6, the handlebars 10 were pulled downwardly, the lever arm 23 would rock or pivot about the pivot bar 42 until the pin 65 were engaged by the edge of the oval bore 63 and pinched between the bore edge and the ends 41 of the yoke arms 21. It will be readily understood that since the yoke arms 21, lever arms 23, bore 63 and pin 65 arrangement are appropriately coordinated, the pin 65 stops downward rocking or pivoting of the lever arm 23, relative to the yoke 45, prior to engagement of the lower pawl extension 58 with the drive gear 20, but after disengagement between the upper pawl extension 57 and the drive gear 20. Thus, movement of the lever arm 23 by manipulation of the handlebars 10 through a downward arc rotates the lever arm 23 and yoke arms 21 downwardly, without rotating the drive gear 20. On the other hand, with the pin 65 removed from bores 63, further pivoting of the lever arm 23 about the pivot bar 42 would be possible, engaging the lower pawl extension 58 with the drive gear 20.

It will be understood that the pin 65 may be utilized in association with the upper oval bores 62 to acommodate an analogous result with respect to upward movement of the lever arm 23 in FIGS. 1, 4 and 6. That is, the pin 65 may be selectively positioned to prevent the upper pawl extension 57 from engaging the drive gear 20 during an upward arc movement of the handle bars 10 in FIG. 6, while at the same time permitting the lower pawl extension 58 to be disengaged from the drive gear 20. Aperture 66 may be utilized for storage of the pin 65 when it is desired that the drive gear 20 be engaged during both the first stroke and the return stroke.

From the above, it will be apparent that the clutch mechanism 15 comprises a three-way clutch 67 selectively utilizable for engagement of the drive gear 20 during either the first stroke, the return stroke, or both, as desired. Thus, a variety of muscle exercise routines may be utilized with the present invention. Also, as previously described, the wave washer 46 may offer sufficient resistance to rotation of the yoke 45 about the axle 25, so that when the clutch mechanism 15 is utilized for disengagement, as for example in FIG. 6 for downward movement of the handlebars 10, the yoke 45 does not so freely rotate that the handlebars 10 would rapidly fall upon the operator 8, FIG. 1, if the handlebars 10 were released. Further, the wave washer 46 helps hold the yoke 45 sufficiently rigidly to facilitate the pivoting of the lever arm 23 about the pivot bar 42 in the manner described.

In the preferred embodiment, FIG. 5, the actuator mechanism 3 includes a cover mechanism 68 generally preventing the drive gear 20 from being exposed. The cover mechanism 68 includes a drum 69 rotatably mounted upon axle 25 and attached to the yoke 45. The drum 69 includes an outer circular plate 70, positioned parallel to the drive gear 20 on an oposite side of the actuator mechanism 3 from the viewer in FIG. 4, and a cylindrical side portion 71 which covers the outside diameter of the drive gear 20, except for the portion through which the dual pawl 55 and lever arm 23 extend. The cover mechanism 68 also includes a fixed plate 72 covering the side of the resistance mechanism 4 facing the viewer in FIG. 4.

Referring FIGS. 1, 2 and 3, the lever arm 23 may be rotated around much of the drive gear 20 so that various orientations of the lever arm 23 can be used for different exercise routines. Further, an adjustable lever arm and handlebar mechanism, or a removable and replaceable one, may be used to accomodate the different exercise routines.

As previously described, the drive gear 20 of the actuator mechanism 3 engages axle gear 30 on the resistance mechanism 4 so that the resistance mechanism 4 selectively cooperates with the actuator mechanism 3 by providing resistance to rotation of the drive gear 20. The resistance mechanism 4 is of a fluid-shearing friction type and includes fluid-shearing friction means similar to that described in the parent application for use in exercise devices such as exercise bicycles. However, the fluid-shearing friction means has been improved and modified here for utilization with reciprocating type actuators for muscle exercises. The resistance mechanism 4 is shown in detail in FIGS. 7 through 13. It will be understood that, preferably, the resistance mechanism 4 is operable regardless of the direction of rotation of the axle 30, so the apparatus 1 is operated, selectively, during both the forward and return strokes. This is accommodated by the fluid-shearing resistance mechanism 4, as described below.

Figure 7:
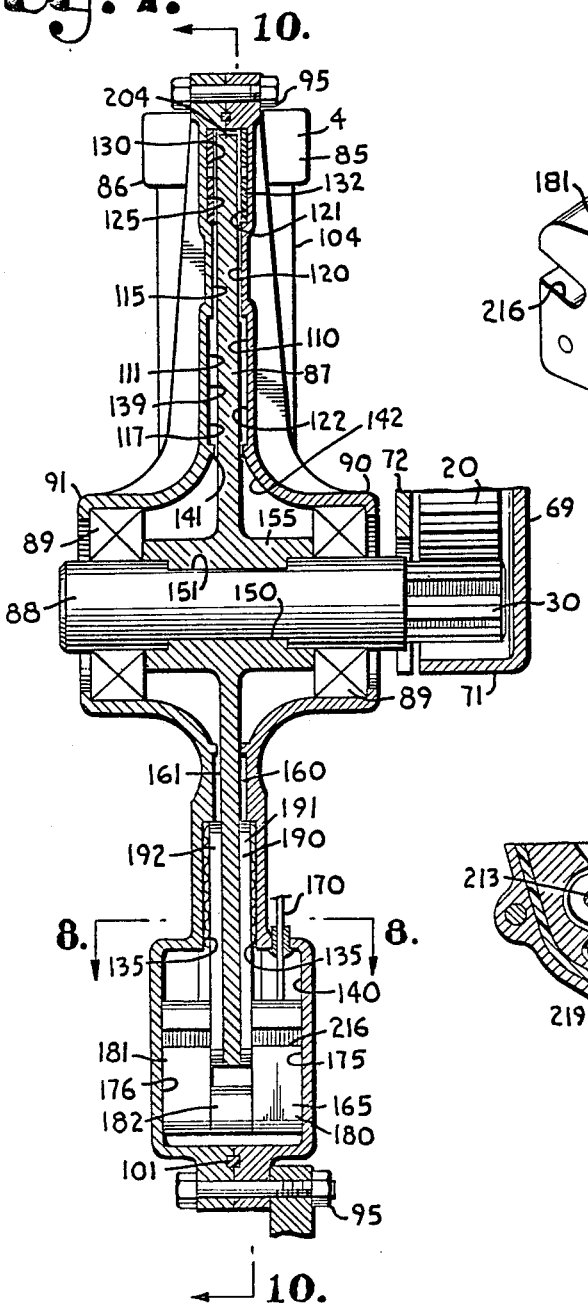
FIG. 7 is an enlarged, fragmentary, front cross-sectional view of a portion of the apparatus taken generally along line 7—7 of FIG. 4.
Figure 10:
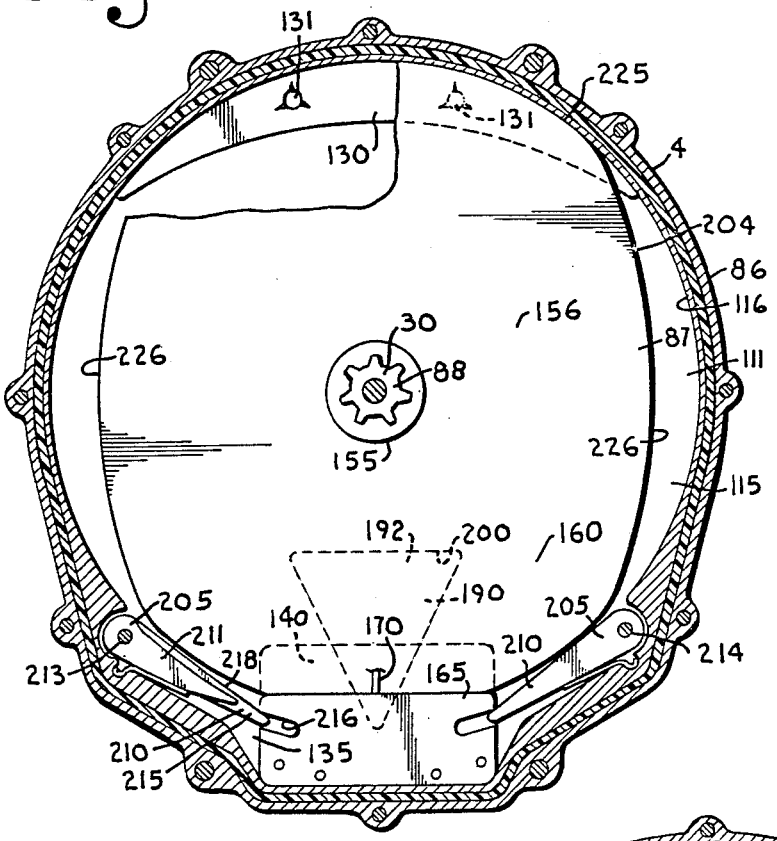
FIG. 10 is an enlarged, side, cross-sectional view of a portion of the apparatus taken generally along line 10—10 of FIG. 7, and with portions broken away to show internal detail.
Figure 11:
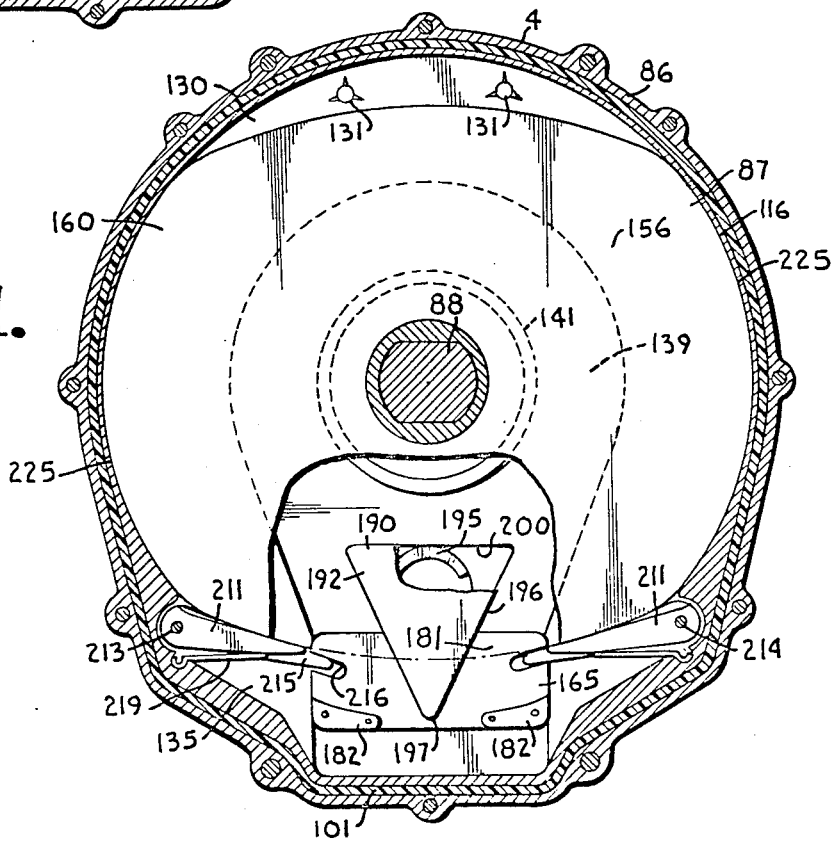
FIG. 11 is an enlarged, side cross-sectional view of a portion of the apparatus taken generally along line 10—10 of FIG. 7 with portions broken away to show internal detail.

Referring to FIGS. 7, 10 and 11, the resistance mechanism 4 includes a housing 85, a cover 86 and a rotating member or rotor 87. FIGS. 10 and 11 are views taken from similar orientations, but with different pieces of the assembly 1 broken away or removed for clarity and understanding. Also, in FIG. 11 the rotor 87, which is oval shaped and has parts broken away in both of FIGS. 10 and 11, is shown rotated approximately ninety (90) degrees from its position in FIG. 10.

The rotor 87 is mounted upon an axle 88 and rotates whenever the axle 88 is rotated within bearings 89. A portion of the axle 88 includes the axle gear 30 for engagement with the actuator mechanism 3 by means of the drive gear 20. Referring to FIG. 7, the housing 85 includes a central hub 90 extending outwardly therefrom. One of the circular bearings 89 is mounted within the hub 90 to support the axle 88. The cover 86 also includes a hub 91 for supporting a circular bearing 89. Generally, the cover 86 is mounted upon the housing 85 as by bolts 95, FIG. 7. Referring to FIG. 4, the entire resistance mechanism 4 is mounted upon the frame 2 by means such as bolts 96.

Figure 13:
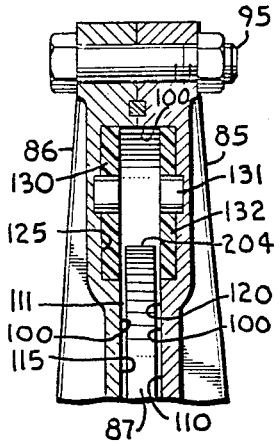
FIG. 13 is an enlarged, fragmentary, front cross-sectional view of a portion of the apparatus, taken generally along line 7—7 of FIG. 4; with FIG. 13 generally representing a detailed enlargement of a portion of FIG. 7.

Referring to FIGS. 7 and 13, fluid receiving spaces 100 are left between the cover 86 and the housing 85. In FIG. 13, the rotor has been rotated ninety (90) degrees relative to FIG. 7. The rotor 87 is mounted upon the axle 88 to rotate within the fluid receiving spaces 100. Generally, fluid will partially occupy the fluid receiving spaces 100 and a seal such as an O-ring type seal 101, FIG. 7, prevents leakage of fluid outwardly from the resistance mechanism 4.

From the above description, it will be understood that the axle 88 is securely but rotatably held in position by the housing 85 and cover 86. Referring to FIG. 4, the cover 86 includes gussets 103 thereon for strength. Similar gussets 104, FIG. 7, in the housing 85 strengthen the housing 85 and help ensure secure support of the axle 88.

The designs of the housing 85, cover 86 and rotor 87 cooperate to form the fluid-shearing type friction resistance mechanism 4 which generates many of the advantages of the present invention. Each of these components is described in detail below. Following the description, a description of their cooperation in operation of the resistance mechanism 4 is given. Reference is made to the parent application for description of a similar fluid-shearing type resistance mechanism used in an exercise cycle. While the fundamental principles of the fluid-shearing type resistance mechanisms described in the parent and instant application are similar, modifications and improvements were made for the instant apparatus. These will be described where appropriate.

Referring to FIG. 7, the housing 85 constitutes a first stationary resistance or stationary shearing member having an inner surface 110 that faces the cover 86 and rotor 87. Similarly, in the preferred embodiment, the cover 86 constitutes a second stationary resistance or stationary shearing member and includes an inner surface 111, FIGS. 7, 10 and 11. For the preferred embodiment described and shown, the housing inner surface 110 and cover inner surface 111 are substantially mirror images of one another.

By reference to FIGS. 7 and 13, it will be understood that the housing inner surface 110 and cover inner surface 111 are irregular. That is, the housing inner surface 110, or by analogy the cover inner surface 111, includes portions which, in relief, are raised or lowered with respect to one another. Referring to FIGS. 7 and 10, the cover inner surface 111 is shown including a circular friction surface or track 115, corresponding to a portion of the cover inner surface 111, which, in relief, is substantially raised and extends somewhat toward the housing 85 and rotor 87, FIG. 7. The cover circular friction track 115 has a substantially circular outer periphery 116 which, except as described below, extends around a central portion 117, FIG. 7, of the cover 86 through which the axle 88 extends. The housing 85 similarly includes a friction track or surface 120, a friction track outer periphery I21, and a central portion 122, FIG. 7.

Referring to FIGS. 7, 11 and I3, the cover inner surface 111 is interrupted by a cover friction relief portion 125. In the preferred embodiment, the cover friction relief portion 125 is a crescent shaped depression in an upper portion of the cover inner surface 111, FIG. 10. A similar arrangement is found in the housing inner surface 110.

A purpose of the cover relief portion 125 is understood by reference to the parent application. If it is desired that the resistance to the rotor 87 substantially vary with a single rotation of the rotor 87 at a constant speed, the relief portion 125 in cooperation with a non-circular rotor 87, provides frictional resistance relief. Such relief was desirable in the parent application, when the fluid-shearing type relief mechanism was used in cooperation with a pedal mechanism for simulating a bicycle ride.

In the instant application of the fluid-shearing type resistance mechanism 4, however, it is preferred that resistance to rotation of the rotor 87 be relatively constant throughout a single rotor 87 rotation at constant speed so that the exercise stroke will feel relatively smooth to the operator 8. Further explanation of this, and the effect of relief portions in the cover 86 and housing 85, follow the rest of the description of the cover 86, housing 85 and rotor 87. For the present, it is to be understood that for use of the fluid-shearing friction type resistance mechanism 4 in cooperation with a muscle exercise type apparatus 1, it is generally preferable that the amount of resistance offered to rotation of the rotor 87 not significantly vary throughout a single rotation of the rotor 87 at a constant speed. In order to acommodate this latter requirement, a resistance space filler, or cover insert 130, FIGS. 11 and 13, is inserted in the cover friction relief portion 125, to substantially fill in the major recess. The insert 130 is substantially crescent shaped, as is the friction relief portion 125 and is removably held in place by mounting pins 131 which may be attached to or be integral with the cover 86. In FIG. 11, the insert 130 is pictured as if made of clear plastic, so the pins 131 are viewable. It will be understood that a similar housing insert 132 is similarly mounted within the friction relief portion in the housing inner surface 110, FIG. 13. Again, the purpose of the inserts 130 and 132 is to selectively fill any substantial relief portions in the housing inner surface and cover inner surface 111. It is foreseeable that the housing 85 and cover 86 could be constructed without any relief portions, making the inserts 130 and 132 unnecessary, however to obtain advantages described below, it may be preferable to have such relief portions in the resistance mechanism 4. It will be understood that if a partial filling of the relief portions is desired, perhaps to allow some resistance relief during a cycle, inserts which less than fill up the relief portions may be utilized.

It will be understood by reference to FIGS. 7, 10 and 11 that the cover friction track 115, and analogously the housing friction track 120, in a preferred embodiment does not continue 360° about the axle 30, but rather each is somewhat horseshoe shaped, and has a gap 135 in its lower portion, where other components of the resistance mechanism 4, described below, are mounted. It will be understood from the below description that the gaps 135 are in part filled up by portions of the resistance mechanism 4, described below, so additional inserts are not required for prevention of substantial cycling in the amount of energy required to rotate the rotor 87 through a single rotation at constant speed. The gaps 135 can be expected, however, to result in some such variance.

The horseshoe shape of the friction tracks 120 and 115 provides a fluid relief drain 139, FIG. 7, around the central axle 88. The drain 139 is formed from relieved portions in the housing inner surface 110 and cover inner surface 111 about the central axle 89. By relieved it is meant that a portion of the cover 86 or housing 85 has been milled or otherwise machined to be lower in relief than the friction surfaces, 115 and 120. Fluid running off of the rotor 87, or housing inner surface 110 and cover inner surface 111, can migrate into the drain 139 and flow toward a reservoir 140 positioned near the bottom of the resistance mechanism 4. Central raised portions 141 and 142, on the cover inner surface 111 and housing inner surface 110 respectively, protect the axle 88 from fluid flow thereto from the drain 139.

As indicated above, the rotor 87 is mounted upon the axle 88 and rotated therewith. Preferably, the rotor 87 is molded plastic or metal cast directly upon the axle 88. Referring to FIG. 7, extensions 150 on the rotor 88 engage indentations 151 in the axle 88 to prevent any substantial slippage in the connection between the rotor 87 and the axle 88.

The rotor 87 includes a central circular hub 155, FIGS. 7 and 10, and a central flat portion 156. Referring to FIGS. 10 and 11, the rotor 87 of the preferred embodiment, is generally a substantially circular member with two crescent or curved chordal segments removed, thus leaving a somewhat oval shape. The relieved or removed chordal segments are oppositely located on the rotor 87, that is the rotor 87 generally has a central, lateral, plane of symmetry.

The central portion 156 of the rotor 87 is generally flat and has a first side or friction surface 160 facing the housing inner surface 110 and a second side or friction surface 161 facing the cover inner surface 111. The rotor 87 generally rotates within a vertical plane and preferably does not substantially wobble with respect to the housing 85 or cover 86, so that a relatively constant shearing motion relationship is maintained between the rotor 87 and the cover 86, or housing 85.

Referring to FIG. 7, if air occupies the chamber or spaces 100 between the rotor 87 and the housing inner surface 110, or cover inner surface 111, then the housing and cover inner surfaces, 110 and 111 respectively, will offer very little resistance to the shearing motion or rotation of the rotor 87 upon rotation of the axle 88. On the other hand, if a viscous fluid, not shown, is placed within the spaces 100, it will tend to cause frictional drag to shearing or rotation of the rotor 87, by a shearing or overlapping action of the rotor surfaces 160 and 161 with respect to the housing 85 and cover 86,by action through the viscous fluid. It is readily seen that as the amount of fluid between the circular friction tracks 115 and 120 and the rotor 87 is increased, greater surface area of the rotor 87 engages, and is covered by, the fluid, and frictional drag is generally increased. It is also readily seen that the shearing action is substantially the same, whether rotation is clockwise or counter-clockwise.

It will be understood that if the rotor were circular, relief portions in the cover 86 and housing 85 would have little effect in varying the amount of resistance during a single rotor cycle, since an amount of frictional or shearing overlap between the rotor 87 and the cover and housing inner surfaces, 111 and 110 respectively, would not vary, during a single rotation cycle. However, an oval shaped rotor 87 has been found to be preferred as it provides advantages in directing viscous fluid motion upwardly and throughout the resistance mechanism 4.

In certain applications, such as the exercise bicycle described in the parent application, it is preferred that friction relief be provided during a single cycle of the rotor. To accommodate this, the friction relief portions described are constructed in the cover 86 and housing 87 of the resistance mechanism 4, again for utilization as a resistance mechanism in devices such as exercise cycles. Thus, while the instant application in a weight device does not generally require such friction relief, and the major friction relief spaces 125 are filled with inserts, the preferred resistance mechanism 4 described herein possesses such a capability so that it may be used as a resistance mechanism in other exercise devices, thus minimizing manufacturing costs and increasing efficiency.

The nature of the fluid-shearing resistance mechanism, in more detail, is as follows:

Referring to FIG. 7, when fluid on the rotor 87 is trapped within spaces 100, that is, substantially adjacent to the cover friction track 115, or housing friction track 120, it will offer significant resistance to rotation of the rotor 87, since the friction tracks 115 and 120 are substantially adjacent the rotor central flat portion 156. When the distance between these parts of the mechanism 4 is greater, as in relieved portions of the cover 86 or housing 85, the fluid will not generate substantial resistance. It is readily understood that when the inserts 130 and 132 are mounted within the resistance mechanism 4, the inserts 130 and 132 themselves form part of the friction or shearing surfaces, generating resistance to rotation of the rotor 87 when viscous fluid is trapped between the rotor 87 and the inserts 130 and 132. On the other hand, when the inserts 130 and 132 are removed from the resistance mechanism 4, the resultant friction relief portions do not offer substantial drag to rotor 87 rotation.

Referring to FIG. 7, the housing 85 and cover 86 cooperate to form the fluid reservoir 140. The fluid reservoir 140 communicates with the fluid receiving space 100 between the housing 85, cover 86 and rotor 87 in the area of the lower gap 135, FIGS. 7 and 11. A fluid level adjustment mechanism including a plunger 165 permits a level of fluid, not shown, in the reservoir 140 to be selectively adjusted. As the plunger 165 is lowered, for example compare FIG. 11 to FIG. 10, the fluid level rises. Referring to FIGS. 7 and 11, at higher fluid levels, greater surface area of the rotor 87 can be expected to be contacted by the fluid, when the rotor is rotated so that portions of it, generally where the rotor is widest, dip into the fluid within the reservior 140. Greater surface area of the rotor 87 covered by the fluid generally results in more resistance to rotor 87 rotation, at a fixed rotational speed.

Figure 9:
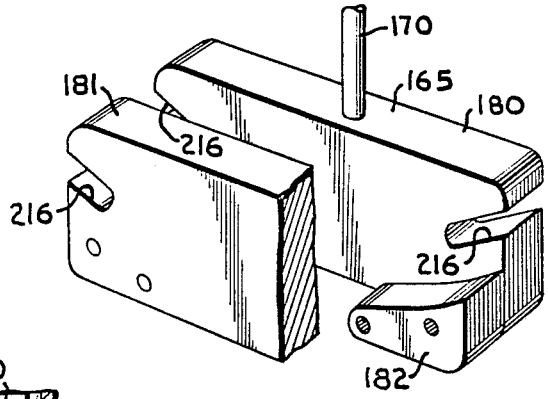
FIG. 9 is an enlarged, fragmentary, side perspective view of a portion of a fluid level adjustment mechanism of the apparatus with portions broken away to show detail.

The plunger 165 is controlled by means of cable 170, FIG. 9. The cable 170 engages the plunger 165 and can be adjusted by means, not shown, to selectively position the plunger 165 within the reservoir 140. Generally, as the plunger 165 is raised, the fluid level decreases, less surface area of the rotor 87 becomes coated with fluid during a cycle, less fluid is carried up into the spaces between the rotor 87, the housing 85 and the cover 86, and rotation of the rotor 87 is made easier. Conversely, as the plunger is lowered, rotation becomes more difficult since more fluid is forced into the fluid receiving spaces 100.

In the preferred embodiment, the fluid reservoir 140 and plunger 165 are symmetrically positioned with respect to the rotor 87. In this manner, the fluid adjustment means comprising the reservoir 140 and plunger 165 has been improved over that described in the parent application, aiding in efficient manufacture of the cover and housing inner surfaces, since they are now generally mirror images of one another.

The desired symmetry in the reservoir 140 is provided by substantially equal depressions 175 and 176, FIG. 7, formed, respectively, in the housing 85 and the cover 86. The desired symmetry is introduced into the plunger 165 by the introduction of a plunger design utilizing first and second halves 180 and 181, FIGS. 9 and 11, with central spacers 182. In FIG. 11, the plunger 165 is shown raised, relative to FIG. 10. Further, in FIG. 11 the plunger 165 is depicted without side 180.

Referring to FIGS. 7 and 9, the plunger second half 181 is generally rectangular and a mirror image of the plunger first half 180, but for attachment of the cable 170 to half 180. The halves 180 and 181 are spaced apart from one another by two spacers 182, FIGS. 9 and 11. These spacers are generally mirror images of one another and are somewhat wedge-shaped. It will be readily understood, by reference to FIGS. 7, 9 and 11, that as the rotor 87 rotates, portions thereof can move within the space between the plunger halves 180 and 181. Thus, the plunger 165 can be partially raised or lowered, as shown in FIGS. 10 and 11, without interference with rotor 87 movement. It will also be understood that fluid can move up into the space between the plunger sides 180 and 181 where it can contact the rotor 87 during rotation. Thus, the fluid will be picked up by the rotor 87 and lifted upwardly in the resistance mechanism 4, during rotor 87 rotation in operation of the apparatus 1.

In the preferred embodiment, the preferred fluid is a silicon fluid having a viscosity of approximately 9000 centistokes. With such a fluid it has been found that a desirable gap between friction generating shearing surfaces, such as the rotor 87 and housing friction track 120, be approximately 0.025 inches. A similar distance spaces the rotor 87 from the cover friction track 115. In relieved portions of the assembly, as for example in the upper crescent chordal segment 125, a distance between the rotor central portion 156 and the housing inner surface 110 or cover inner surface 111, of approximately 0.150 inches has been found effective. It will be understood that when the spacers 130 and 132 are inserted, the relief is diminished to approximately 0.025 inches, that is, any friction relief offered by the relieved portion in which the insert is placed is essentially negated.

Control of the location of the fluid upon the rotor 87 is generally maintained by a wiper mechanism 190, FIGS. 10 and 11. Referring to FIG. 7, the wiper mechanism 190 includes a first blade 191 mounted within the housing 85 and a second blade 192 mounted within the cover 86. The blades, 191 and 192, are substantially identical to one another and symmetrically mounted within the resistance mechanism 4.

Referring to FIG. 11, the blade 192 is triangularly shaped and mounted upon a spring 195, with a vertex pointed downwardly, generally directed between the sides 180 and 181 of the plunger 165. In FIG. 11, a portion of the triangular blade 192 and rotor 87 have been broken away to make the spring 195 viewable. In FIG. 10, the entire blade 192 is shown, in phantom lines, behind the rotor 87. The spring 195 tends to bias the wiper blade 192 against the rotor 87. Referring to FIG. 11, if the rotor 87 is rotated clockwise, fluid thereon, on the side facing the cover 86 away from the viewer, will engage lead edge 196 on the wiper blade 192. The lead edge 196, angled downwardly, tends to force the fluid toward the tip 197 of the blade 192. This tends to keep excess fluid off of the rotor 87 and also tends to direct fluid toward an outer periphery of the rotor 87. It will be understood that the wiper mechanism 190 is symmetrical and operates whether rotation of the rotor 87 is clockwise or counter-clockwise. Further, it will be understood that the wiper mechanism 190 operates on both surfaces 160 and 161 of the rotor 87. It will also be understood that the wiper blade 192 in the cover friction track 115 is mounted within, and generally fills, a triangular shaped relieved area 200 in the housing inner surface 110. The wiper blade 191 on the housing side of the rotor 87 is similarly mounted.

During operation of the resistance mechanism 4, excess fluid could tend to build up on the rotor 87 along either of its sides 160 and 161, or along its outer periphery 204, FIG. 7. Therefore, the resistance mechanism 4 includes a scraper mechanism 205 to remove any such excess fluid.

The scraper mechanism 205 includes four side scrapers 210 and two outside diameter or outer periphery scrapers 211. The six scrapers are mounted in two sets of three with a single outside diameter scraper 211 sandwiched between two of the side scrapers 210. Referring to FIGS. 10 and 11, a first group of three scrapers is pivotally mounted upon pin 213 and a second group is pivotally mounted on pin 214. In each group the three scrapers are generally capable of independent pivoting movement with respect to one another.

Referring to in FIG. 10, on each pin 213 and 214, all three scrapers, two scrapers 210 and one outer periphery scraper 211, are mounted. However, in the view of FIG. 10 only one of the outer scrapers 210 on pin 214 is viewable. However, the scraper on pin 213 has been removed, to show the outer periphery scraper 211, which would otherwise, generally, be out of view. It will be understood that a second side scraper 210 is mounted on each pin, 213 and 214, on a side opposite the rotor 87 and generally out of view. A tip 215 of one of the "backside" scrapers is viewable on pin 213.

In FIG. 11, each set of three scrapers is shown with the side scraper closest to the viewer removed, enabling the outside diameter scrapers 211 to be viewed.

Referring to FIG. 10, each side scraper 210 includes a tip 215 which extends into a slot 216 in the plunger 165. Referring to FIG. 9, the plunger 165 includes four such slots 216, one for each of the side scrapers 210, with a pair of side scrapers 210 being positioned on each side of the rotor 87. It will be readily understood by reference to FIG. 10, and comparison of FIGS. 10 and 11, that as the plunger 165 is raised and lowered, the side scrapers 210 are pivoted within the resistance mechanism 4.

Referring again to FIGS. 7 and 9, as the rotor 87 rotates down between the sides 180 and 181 of the plunger 165 it dips into fluid located within the fluid reservoir 140. As it leaves the fluid reservoir 140 it passes between a pair of side scrapers 210. For example, if rotation is clockwise, in FIG. IO, side scrapers 218, only one of which is partially visible in FIG. 10 the other being similarly positioned on the side of the rotor 87, facing the viewer, but removed in FIG. 10 for clarity, control the amount of fluid carried upwardly by the rotor 87. The side scrapers 218 are positioned sufficiently close to the rotor 87 to remove any excess fluid by scraping it away from the rotor 87. When the plunger 165 is at its lowest, the scrapers 210 have less overlap with the rotor 87, and a greater amount of fluid is transferred upwardly, causing greater frictional resistance.

Figure 12:
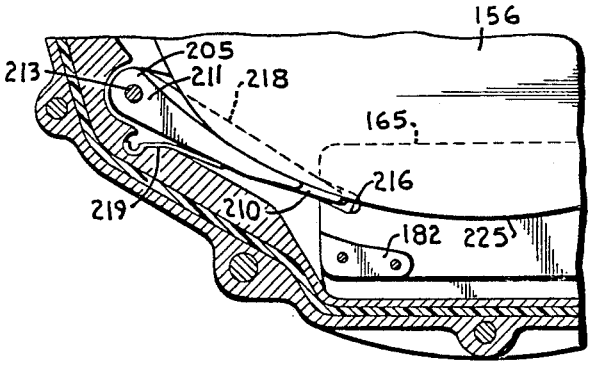
FIG. 12 is an enlarged, fragmentary, side, cross-sectional view of a portion of the apparatus taken generally along line 10—10 of FIG. 7 and with portions broken away to show internal detail.
Figure 8:
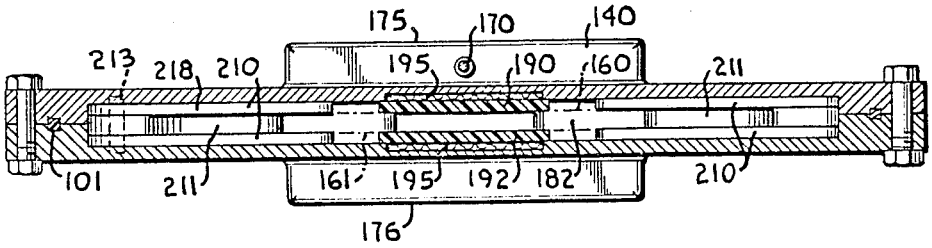
FIG. 8 is an enlarged, top, cross-sectional view of a portion of the apparatus taken generally along line 8—8 of FIG. 7.

Referring to FIGS. 11 and 12, the outside diameter scraper 211, as described above, is pivotally mounted upon pin 213, between a pair of side scrapers 210. The outside diameter scraper 211 is pressed upwardly by leaf spring 219, and in FIG. 11, the scraper 211 is shown abutting the outer periphery 204 of the rotor 87. Thus, the outside diameter scraper 211 will remove excess fluid on the outer periphery 204. It will be understood that the leaf spring 219 maintains contact between the outside diameter scraper 211 and the rotor 87, as the rotor 87 rotates, even though the rotor 87 is oval rather than circular. However, in the preferred embodiment each leaf spring 219 is sufficiently wide so that at a selected point when the side scrapers 210 are pressed downwardly by the plunger 165, FIG. 10, the leaf springs 219 are bent downward by the side scrapers 210, allowing the outer periphery scrapers 211 to fall away from the rotor 87, with the result being an increase in the amount of fluid transferred upwardly by the rotor 87, and greater resistance action the mechanism 4. Again, this is illustrated in FIG. 10.

Referring to FIGS. 10 and 11, the rotor 87 can be described as an oval having a perimeter of four arc portions including a first pair of equal and opposite arc portions 225 and a second pair of equal and opposite arc portions 226. In the preferred embodiment arc portions 225 are both positioned on the perimeter of a circle having a diameter of approximately ten (10) inches. Each arc portion 225 extends through an angle of approximately 80° . The second pair of arc portions 226 connect the ends of the first pair of arc portions 225. Each of the second pair of arc portions 226 can be described as an arc of a circle having a radius of approximately 7.7 inches. From these dimensions it will be understood that the resistance mechanism 4 can be relatively small, allowing for a relatively lightweight, compact, exercise apparatus 1. It is foreseen that a variety of rotor shapes and dimensions, however, may by utilized ccording to the present invention.

It will be understood that a variety of gear ratios may be selected for ratio between the drive gear 20 and the axle gear 30. It will also be readily understood that the performance of the apparatus 1 will, in part, be dependent upon the gear ratio chosen, that is, the amount of the rotation of the rotor 87 from a single stroke on the lever arm 23 depends upon the gear ratio above mentioned. This can be related to the total amount of resistance generated by the resistance mechanism 4 per stroke on the lever arm 23. Of course, adjustment in this amount of resistance, at a fixed gear ratio, can be accommodated by the fluid adjustment mechanism comprising the reservoir 140 and plunger 165. In the preferred embodiment, a gear ratio of the drive gear 20 to the axle gear 30 of about 120 to 7 has been found preferable. It has been found that for a typical bench press an arc movement of about fifty degrees, (50° ), is comfortable for exercisers. This, it will be apparent, can be correllated with an amount of rotor rotation to calculate total muscle exertion over a given peroid of time.

If the apparatus 1 has been allowed to stand, unused, for a substantial period of time, substantially all of the fluid in the fluid receiving space 100 will have drained downwardly into the fluid reservoir 140. Effective resistance by the resistance mechanism 4, following apparatus re-start up, under such circumstances, would not be achieved until sufficient fluid has been transferred back up into the fluid receiving spaces 100 by the rotor 87. It will be readily understood that an advantage to a relatively high gear ratio between the drive gear 20 and the axle gear 30 is that the resistance mechanism 4 will be fully activated, by movement of fluid upwardly upon rotor 87 rotation, without much movement of the lever arm 23. Thus, the operator 8 generally need not greatly pump the apparatus 1 to get it effectively operating at full resistance.

Operation of the assembly 1 and cooperation of the components in operation, may be understood by initial reference to FIG. 1. As previously described, in FIG. 1 the apparatus 1 is being shown utilized for a bench press type exercise. The operator 8 lies upon bench 6 and grips the handlebars 10, as shown. To simulate a bench press with weights, the clutch mechanism 15 is adjusted so that the resistance mechanism 4 will be engaged by the actuator mechanism 3 as the handlbars 10 are pushed upwardly, and the clutch mechanism 15 is also adjusted so that the resistance mechanism 4 is not engaged as the handlebars 10 are lowered. The exerciser 8, then, pushes upwardly on the bars 10, which move in an upward direction along the arc described by arrows 11. During the upward motion, the drive gear 20 is rotated, rotating the axle gear 30 and thereby the rotor 87. If viscous fluid is in the reservoir 140 and the plunger 165 is appropriately actuated, as the rotor 87 rotates viscous fluid is carried up into the fluid receiving spaces 100. The viscous fluid will become entrapped between the housing friction track 120, the cover friction track 115 and the rotor 87. Shearing action of the rotor 87, as it rotates with respect to the cover 86 and housing 85, with the fluid trapped therebetween, is resisted by this arrangement. The amount of resistance can, as described, be adjusted by adjusting the fluid adjustment mechanism. As previouly described, the inserts 130 and 132 also similarly form part of the stationary shearing surfaces against which the rotor 87 acts.

During a single stroke in the bench press, the operator may, for example, make a maximum effort to push the bar 10 upwardly as fast as posible. Assuming maximum effort to be exerted, the muscles will be at a maximum strain throughout the stroke as the arms extend, since as the arms straighten out to where strength and mechanical advantage is greatest, the lever arm 23 will simply move faster through the arc in response to the greater force exerted. However, unlike with weights where the downward pressure, but for acceleration, is relatively constant, if the speed of rotation of the drive gear 20 increases, rotation of the rotor 87 increases, and resistance increases. This is due to the fact the amount of resistance in the fluid-shearing type resistance mechanism 4 increases as the speed of the rotor 87, in rotation, increases. Thus, while the speed of arc movement of the handlebars 10 may increase for the exerciser 8, it will not actually become significantly easier, or require less muscle effort, for the exerciser 8 to move the bar 10 at any point in the rotation. This assumes that appropriate inserts are utilized in the resistance mechanism 4 so that resistance to rotation of the rotor B7 is relatively constant throughout a single rotation. This also assumes the gaps 135 in the lower part of the friction tracks 115 and 120 are made sufficiently small to not result in much friction relief during a rotation of the non-circular rotor 87.

Also, as previously described, if at any point during the first stroke the exerciser 8 should choose to stop maximum effort upwardly, upward movement of the handlebars 10 would slow down or stop, but the handlebars 10 would not begin to descend rapidly and with great force since there is no significant weight upon them tending to drive them downwardly, as with a weight machine or weights. Also as previously described, friction washer 46 will aid in preventing the handlebars 10 from falling upon the operator 8, should he completely release the bar 10.

It will be understood, as previously described, that a variety of lever arms 23 and handlebars 10 may be utilized, and further that the lever arm 23 and handlebars 10 can be removably mounted upon pivot bar 42 so that handlebar and lever arm sets may be changed.

In FIG. 2, the apparatus is shown being utilized for arms curls. Here, the lever arm 23 has been changed so that it is shorter, and the 1ever arm has been rotated around to a backside of the drive gear 20, and is angled upwardly and away from the bench 6. The operator 8 sits upon the bench 6 facing the resistance mechanism 4 and actuator mechanism 3, straddling same. The handlebars 10 are gripped and the arm curls performed. It is likely that in this arrangement the clutch 15 will have been adjusted so the resistance mechanism 4 is engaged when the arms are pulled toward the operator 8 and disengaged during the return stroke. However, as will be understood from the previous description, other arrangements of the clutch 15 are possible. Generally, the elbows of the exerciser 8, in performing arm curls, will be approximately aligned with points 228 on a rotation axis of the drive gear 20, however different exercisers may be more or less comfortable with different arrangements.

Referring to FIG. 3, the apparatus 1 is shown adjusted for use in performing leg curls. Here, the bench upper surface 9 is shown with a seat adjustable portion 230 and a back adjustable portion 231 oriented for sitting in a reclining position, as opposed to FIGS. 1 and 2 where they are flat. These portions are foreseen to be adjustable by any of numerous appropriate means to be positioned as shown for an operator 8 to sit with his legs extending generally toward, and straddling, the actuator mechanism 3 and resistance mechanism 4. Generally, the exerciser's knees will be brought near points 232 on the rotation axis of the drive gear 20. In this arrangement an appropriate lever arm with leg couplings 235 is appropriately oriented for the leg curls. This is also shown in phantom lines in FIG. 4. Again the clutch mechanism 15 may be selectively adjusted as desired, for resistance during a forward stroke or kick, or resistance during the return stroke, or both, as desired.

It will be readily understood from FIGS. 1 through 3, that all of the exercises shown can be accomplished with the same exercise apparatus 1 having an appropriate set of interchangeable lever arms or a single appropriately adjustable, lever arm.

Generally, a variety of materials may be utilized to construct the apparatus 1, however, advantages are derived from relatively lightweight materials. The rotor 87 may be constructed either of a plastic or of an appropriate metal. The cover and housing will generally preferrably be made from a suitably strong material having sufficient heat transfer capabilities. A reason for this is that it is envisioned that rotation of the rotor, and frictional engagement of the fluid, may tend to generate heat, and the heat should be dissipated or the fluid may tend to heat and lose its viscosity. If the cover and housing have sufficiently high heat transfer capabilities, the heat may be radiated through the cover and housing and lost in the atmosphere. Usually, the cover and housing are appropriately milled or cast pieces of light metal or plastic.

It is foreseen that electronic timing or measuring equipment, or diagnostic equipment, may be utilized in association with the present invention to measure the movement of the lever arm 23 or drive gear 20, and thus measure the energy output of the exerciser 8. Typically, this would require a measurement of the length of time it takes to rotate the drive gear 20 through a defined arc and comparing it to standard curves developed for a specified resistance mechanism at a specified fluid level.

It is to be understood that while certain forms of the present invention have been illustrated and described herein, it is not to be limited to the specific forms or arrangement of parts described and shown.

What is claimed and desired to be secured by Letters Patent is as follows:

1. A muscle exercise apparatus for providing exercise to an operator, said apparatus comprising:

(a) a resistance mechanism including fluid-shearing friction means; said fluid-shearing friction means including a rotor and a resistance surface;

(i) said rotor having a friction surface and being mounted with said friction surface generally facing said resistance surface; said rotor friction surface being spaced from said resistance surface, forming a fluid receiving space therebetween;

(ii) said rotor being rotatably mounted, rotation of said rotor causing rotation of said rotor friction surface relative to said resistance surface; and, (b) actuator means for selectively rotating said rotor; and (i) said actuator means including a reciprocating mechanism having an actuator member selectively movable between a first extreme position and second extreme position;

(ii) movement of said actuator member selectively rotating said rotor, with movement of said actuator member from said first extreme position to said second extreme position corresponding to a first stroke, and with selective movement of said actuator member from said second extreme position to said first extreme position corresponding to a return stroke; movement of said actuator member during said return stroke being through a reverse path of movement of said first stroke;

(iii) said first stroke selectively rotating said rotor; and (c) a viscous fluid positioned in said fluid receiving space; said fluid, causing frictional drag and resistance to rotational movement of said rotor relative to said resistance surface;

(d) whereby, selectively, when said operator moves said actuator member through said first stroke, energy is required to overcome said resistance and said operator receives exercise by providing said energy.

2. An exercise apparatus according to claim 1 including:

(a) fluid level adjustment means for selectively adjusting an amount of fluid positioned in said fluid receiving space;

(b) whereby an amount of energy required to rotate said rotor, at a constant rotational speed, may be selectively increased or decreased by adjustment of said amount of fluid in said receiving space.

3. An exercise apparatus according to claim 1 wherein:

(a) said actuator means includes a resistance mechanism engagement device selectively coupling said actuator member to said rotor, permitting translation of movement of said actuator member to rotation of said rotor;

(i) said resistance mechanism engagement device selectively operable to couple said actuator member to said rotor during said first stroke; and, (ii) said resistance mechanism engagement device selectively operable to couple said actuator member to said rotor during said return stroke;

(b) whereby resistance to movement of said actuator member, by said resistance mechanism, is selectively provided during said first stroke, said return stroke, or both.

4. A muscle exercise apparatus for providing exercise to an operator, said apparatus comprising:

(a) a resistance mechanism including fluid-shearing friction means; said fluid-shearing friction means including a rotor and a resistance surface;

(i) said rotor having a friction surface and being mounted with said friction surface generally facing said resistance surface; said rotor friction surface being spaced from said resistance surface, forming a fluid receiving space therebetween;

(ii) said rotor being rotatably mounted, rotation of said rotor causing overlapping rotation of said rotor friction surface relative to said resistance surface; and, (b) actuator means for selectively rotating said rotor; said actuator means including a rotating member, an actuator member, and an engagement clutch;

(i) said actuator member being selectively movable between a first extreme position and a second extreme position; selective movement of said actuator member from said first extreme position to said second extreme position corresponding to a first stroke, and selective movement of said actuator member from said second extreme position to said first extreme position corresponding to a return stroke; movement of said actuator member during said return stroke being through a reverse path of movement to said first stroke;

(ii) said engagement clutch selectively engaging said actuator member with said rotating member to selectively rotate said rotating member in a first direction during said first stroke and to selectively rotate said rotation member in a second direction during said return stroke;

(iii) said engagement clutch including first and second pawl members; said first pawl member selectively engaging said actuation member with said rotating member during said first stroke and said said second pawl member selectively engaging said actuation member with said rotating member during said return stroke;

(iv) said rotating member cooperating with said rotor to selectively rotate same when said rotating member is rotated;

(c) whereby fluid is selectively positionable in said fluid receiving space; said fluid, when sufficently viscous, causing frictional drag and resistance to rotational movement of said rotor to said resistance surface; and (d) whereby selected movement of said actuator member, through either said first stroke, said return stroke, or both, as selected, by said operator, requires energy to overcome said resistance and said operator receives exercise by providing said energy.

5. An exercise apparatus according to claim 2 wherein:

(a) said housing inner surface includes a recessed relief portion with retaining means thereon;

(b) said cover inner surface includes a recessed relief portion with retaining means thereon;

(c) said apparatus includes a housing insert selectively mountable upon said housing recessed relief portion; and (d) said apparatus includes a cover insert selectively mountable upon said cover recessed relief portion;

(e) whereby a volume of, and shape of, said fluid receiving spaces may be selectively adjusted by mounting or dismounting said inserts from said apparatus.

6. An exercise apparatus according to claim 5 including:

(a) a bench upon which said resistance mechanism, said fluid level adjustment means and said actuator means are mounted;

(i) said actuator member including a press bar mechanism;

(ii) said actuator means being mounted on said bench with said press bar oriented for engagement by an operator doing a bench press;

(b) whereby said apparatus is usable for bench press exercises.

7. An exercise apparatus according to claim 1 including:

(a) a bench upon which said resistance mechanism, said fluid level adjustment means and said actuator means are mounted;

(i) said actuator means including an actuator member orientation adjustment mechanism for selectively orienting said actuator member for engagement by an operator in a plurality of selected positions on said bench;

(ii) said actuator member being selectively removably mounted upon said actuator means and being selectively replaceable within said actuator means by alternate actuator members;

(b) whereby upon selection of, and selected orientation of, an appropriate actuator member, said apparatus may be utilized by said operator for bench press exercises, arm curl exercises and leg curl exercises.

8. An exercise apparatus according to claim 7 including:

(a) a wiper mechanism generally urging fluid on said rotor friction surfaces substantially toward an outer periphery of said rotor;

(b) whereby a relatively even distribution of fluid on a selected portion of said rotor friction surface is maintained.

9. An exercise apparatus according to claim 8 wherein:

(a) said wiper mechanism includes a wiper blade nonrotatably mounted adjacent said rotor friction surface.

10. An exercise apparatus according to claim 9 including:

(a) a scraper mechanism for partially removing fluid from an outer periphery of said rotor.

11. An exercise apparatus according to claim 10 wherein:

(a) said fluid level adjustment means includes a plunger and reservoir mechanism, said plunger having first and second sides with said rotor passing partially therebetween during said rotation;

(b) whereby selected adjustment of a depth of extension of said plunger in said reservoir, when said reservoir includes an appropriate fluid therein, provides selected adjustment of a height of fluid within said reservoir and an amount of fluid in said fluid receiving spaces.

12. A muscle exeroise apparatus for providing exercise to an operator, said apparatus comprising:

(a) a resistance mechanism including fluid-shearing friction means; said fluid-shearing friction means including a rotor and a resistance surface;

(i) said rotor having a friction surface and being mounted with said friction surface generally facing said resistance surface; said rotor friction surface being spaced from said resistance surface and forming a fluid receiving space therebetween;

(ii) said rotor being rotatably mounted, rotation of said rotor causing rotation of said rotor friction surface relative to said resistance surface; and (b) actuator means for selectively rotating said rotor;

(i) said actuator means including a reciprocating mechanism having an actuator member selectively movable between a first extreme position and second extreme position;

(ii) movement of said actuator member selectively rotating said rotor, with movement of said actuator member from said first extreme position to said second extreme position corresponding to a first stroke, and with selective movement of said actuator member from said second extreme position to said first extreme position corresponding to a return stroke; movement of said actuator member during said return stroke being through a reverse path of movement of said first stroke;

(iii) said first stroke selectively rotating said rotor;

(c) whereby fluid is selectively positionable in said fluid receiving space; said fluid, when sufficiently viscous, causing frictional drag and resistance to rotational movement of said rotor relative to said resistance surface;

(d) whereby, selectively when said operator moves said actuator member through said first stroke, energy is required to overcome said resistance and said operator receives exercise by providing said energy;

(e) fluid level adjustment means for selectively adjusting an amount of fluid positioned in said fluid receiving space; whereby an amount of energy required to rotate said rotor, at a constant rotational speed, may be selectively increased or decreased by adjustment of said amount of fluid in said receiving space; and (f) said rotor being substantially oval shaped and rotating in a plane spaced apart from and generally parallel to said resistance surface, to thereby vary the amount of resistance to rotation of said rotor between said first and second extreme positions.

13. A muscle exercise apparatus for providing exercise to an operator, said apparatus comprising:

(a) a resistance mechanism having a housing, a rotor and a cover;

(i) said housing having an inner surface;

(ii) said rotor being rotatably mounted in said resistance mechanism and having a first friction surface and a second friction surface; said first friction surface facing said housing inner surface and being spaced apart therefrom to form a first fluid receiving space therebetween; rotation of said rotor causing overlapping movement of said rotor first friction surface relative to said housing inner surface;

(iii) said cover having an inner surface said rotor second friction surface facing said cover inner surface and being spaced apart therefrom to form a second fluid receiving space therebetween; said rotation of said rotor causing overlapping movement of said rotor second friction surface with respect to said cover inner surface;

(b) fluid level adjustment means for selectively adjusting an amount of fluid positioned in said first and second fluid receiving spaces;

(c) actuator means for selectively rotating said rotor;

(i) said actuator means including a reciprocable mechanism having an actuator member selectively movable between a first extreme position and a second extreme position;

(ii) movement of said aotuator member selectively rotating said rotor, with selective movement of said actuator member from said first extreme position to said second extreme position corresponding to a first stroke, and with selective movement of said actuator member from said second extreme position to said first extreme position corresponding to a return stroke; movement of said actuator member during said return stroke being through a reverse path of movement to said first stroke; said first stroke selectively rotating said rotor;

(d) viscous fluid positioned in said fluid receiving spaces; said fluid causing frictional drag and resistance to rotation of said rotor with respect to said cover and said housing;

(e) whereby, selectively, when said operator actuates said actuator member, through said first stroke, energy is required to overcome said resistance and said operator receives exercise by providing said energy;

(f) whereby an amount of energy required to rotate said rotor, at a constant speed, may be selectively increased or decreased by adjustment of an amount of fluid in said receiving spaces; and (g) clutch means selectively engaging said actuator member to couple said actuator member to said rotor; whereby said rotor may be selectively rotated during said first stroke, or said return stroke, or both.

14. A muscle exercise apparatus for providing exercise to an operator and comprising:

(a) frame means;

(b) a fluid sealing housing positioned on said frame means;

(c) a first fluid-shearing friction surface positioned within said housing;

(d) a movable member sealingly positioned within said housing, said movable member including a second fluid-shearing friction surface, the second surface being positioned in closely spaced and facing relation to the first surface to form a fluid receiving space therebetween, and said movable member being movable within said housing thereby moving said second surface substantially parallel to said first surface;

(e) an actuator member operatively connected to said movable member for grasping by an operator to move said movable member toward opposite extreme positions upon reciprocating movement of said actuator member; and (f) a viscous fluid sealed within said housing and positioned within said fluid receiving space to cause fluid-shearing frictional resistance to the movement of said second surface relative to said first surface to thereby provide exercise to an operator in moving said actuator member.

15. An apparatus according to claim 14 wherein:

(a) said housing, said first surface, said movable member, said second surface, and said fluid form a first fluid-shearing friction resistance assembly;

(b) said apparatus includes a second fluid-shearing friction resistance assembly substantially similar to the first assembly, the second assembly being positioned on said frame means in spaced relation to said first assembly and including a second movable member; and (c) said actuator member is operatively connected to the movable members of said first and second assemblies for movement substantially in unison.

16. An apparatus according to claim 14 wherein:

(a) said movable member is rotatably mounted within said housing; and (b) rotation of said movable member moves said second surface substantially parallel to said first surface.

17. An aparatus according to claim 16 including:

(a) a first gear affixed to said movable member and rotatable therewith;

(b) a second gear rotatably mounted on said frame means and meshed with said first gear; and (c) said actuator member being connected to said second gear whereby movement of said actuator member operatively rotates said second gear and thereby causes the rotation of said first gear and said movable member therewith.

18. An apparatus according to claim 17 including:

(a) clutch means connecting actuator member with said second gear and selectively operable to cause the rotation of said second gear member in one or both directions of reciprocating movement of said actuator member; and (b) selector means associated with said clutch means and operable to select the direction of reciprocating movement of said actuator member in which said clutch means causes the movement of said second gear.

19. An apparatus according to claim 14 including:

(a) clutch means operatively connecting said actuator member to said movable member and selectively engageable to cause the movement of said movable member in one direction of reciprocating movement of said actuator member such that movement of said actuator member in the other direction of reciprocating movement does not cause movement of said movable member.

* * * * *